US006026937A

United States Patent [19]

Hayashi et al.

[11] Patent Number: 6,026,937

[45] **Date of Patent: *Feb. 22, 2000**

[54] ELEVATOR CAB

[75] Inventors: Satoshi Hayashi, Yokohama; Wataru Takeuchi, Tokyo-To, both of Japan

[73] Assignee: Otis Elevator, Farmington, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/970,225

[22] Filed: Nov. 14, 1997

[30] Foreign Application Priority Data

Nov. 14, 1996 [JP] Japan ..... 8-302620

[51] Int. Cl.[7] ..... B66B 9/02; B66B 11/02

[52] U.S. Cl. ..... 187/401; 187/270

[58] Field of Search ..... 187/270, 401, 187/254, 406, 414

[56] References Cited

U.S. PATENT DOCUMENTS

| | | | |
|---|---|---|---|
| 1,348,138 | 7/1920 | Hunt | 187/270 |
| 5,207,295 | 5/1993 | Bialy et al. | 187/401 |

FOREIGN PATENT DOCUMENTS

| | | |
|---|---|---|
| 1077845 | 3/1960 | Germany . |
| 2138395 | 10/1984 | United Kingdom . |

*Primary Examiner*—Christopher P. Ellis
*Assistant Examiner*—Gene O. Crawford

[57] ABSTRACT

An elevator cab includes an indentation in the shape of the cab. The indentation permits the cab to be compact without compromising the floor area of the cab. In a particular embodiment, the indentation accommodates the presence of a machine in the hoistway when the cab is adjacent to the machine.

6 Claims, 6 Drawing Sheets

ELEVATOR CAB

TECHNICAL FIELD

The present invention relates to elevator systems, and more particularly to elevator cabs for such elevator systems.

BACKGROUND OF THE INVENTION

FIG. 6 is an illustration of a conventional elevator system. In this figure, the car (101) comprises a cab (102) and a car frame (103) that supports this cab (102). One end of a rope (104) is attached to the car flame (103), with this rope (104) being applied to a sheave (106) of a hydraulic cylinder (105). When this hydraulic cylinder (105) is operated, the car (101) moves up and down.

The cab (102) is generally designed to provide a predetermined floor area For instance, for home elevators the floor area may be 1.1 $m^2$ or smaller. Since the floor area of the cab (102) is designed in this manner, the size of this cab (102) will be determined based on the size of the floor.

However, in a car structure of such a conventional elevator, the car flame (103) is positioned outside of the cab (102). Thus, there is the problem that the size of the car (101) as a whole, which includes the size of the cab (102) plus the car frame (103), will be large relative to the available space in the building in which it is disposed. In addition, if the machinery used to drive the car is located within the hoistway, this will require either a reduction in the size of the car or an enlargement in the size of the hoistway.

DISCLOSURE OF THE INVENTION

An object of the present invention is to make the car as a whole compact while maximizing the capacity of the cab.

According to the present invention, an elevator cab includes a platform, a ceiling and a side panel that extends between the platform and ceiling, wherein the side panel includes an indentation.

In one embodiment, the indentation is located at the engagement between the side panel and the ceiling. In this embodiment, the present invention provides the advantage that the size of the cab is minimized without compromising the floor area within the cab.

In another embodiment, the indentation is located such that it faces the machine when the cab is adjacent to the machine in the hoistway. In this embodiment, the indentation accommodates the presence of the machine in the hoistway. As a result, the machine may be located in the hoistway and the need for a separate machine room, or an extension of the hoistway, is eliminated.

According to a particular embodiment, the present invention has the following structure: it is equipped with a cab that is installed to be vertically movable in an elevator hoistway, a side frame positioned on the side of the side panel or on the side of the rear panel of the cab, and a bottom frame positioned on the floor of the aforementioned cab. Roller guides are provided at both the top and the bottom of the car frame, with the roller guides being engaged with guide rails so as to slide. The side frame and bottom frame constitute the car frame. The cab is supported by this car frame to slide freely in the guide rails by means of the roller guides. The portion outside of the side frame bulges relatively outward at the side panel or the rear panel of the cab positioned by the side frame.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

The present invention will be explained based on the accompanying figures. FIGS. 1 through 5 are diagrams that illustrate an exemplary example of a cantilevered elevator car structure in accordance with the present invention.

Figure 4:
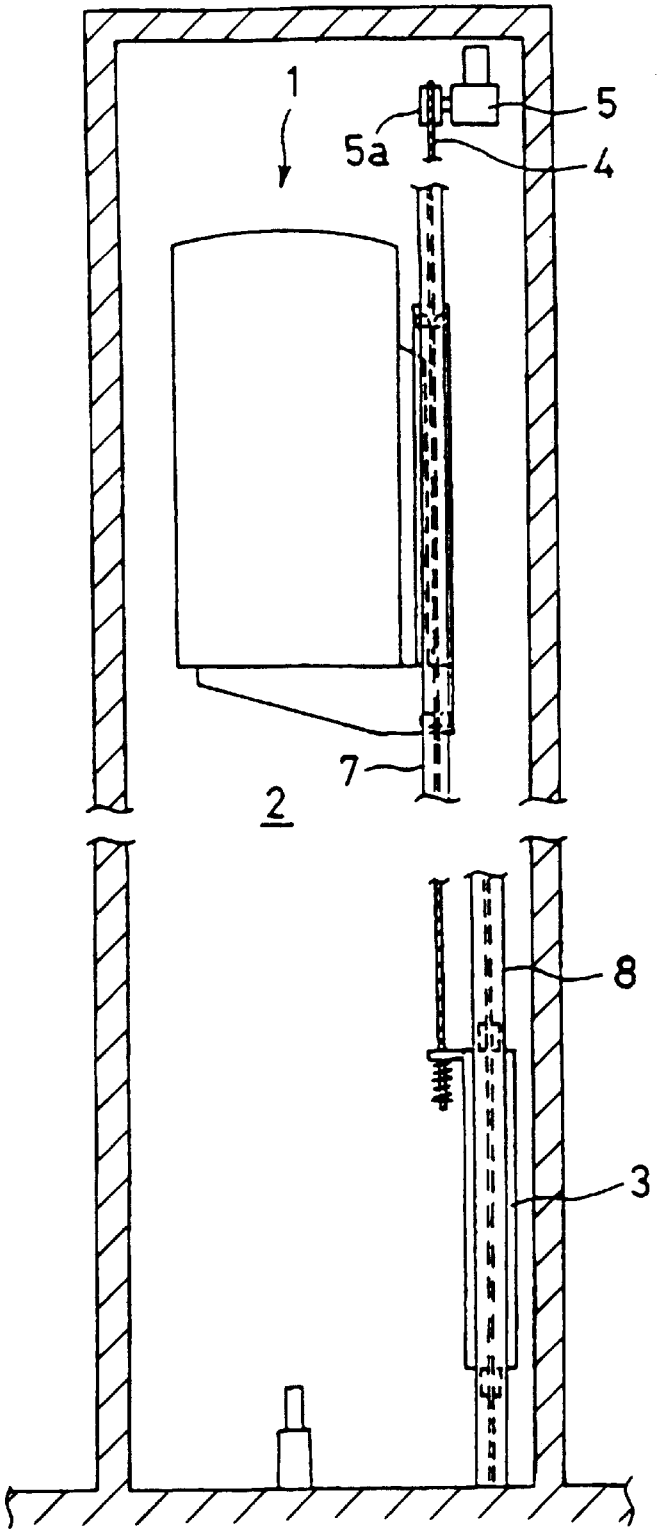
FIG. 4 is a front view of the elevator system including a counterweight.
Figure 5:
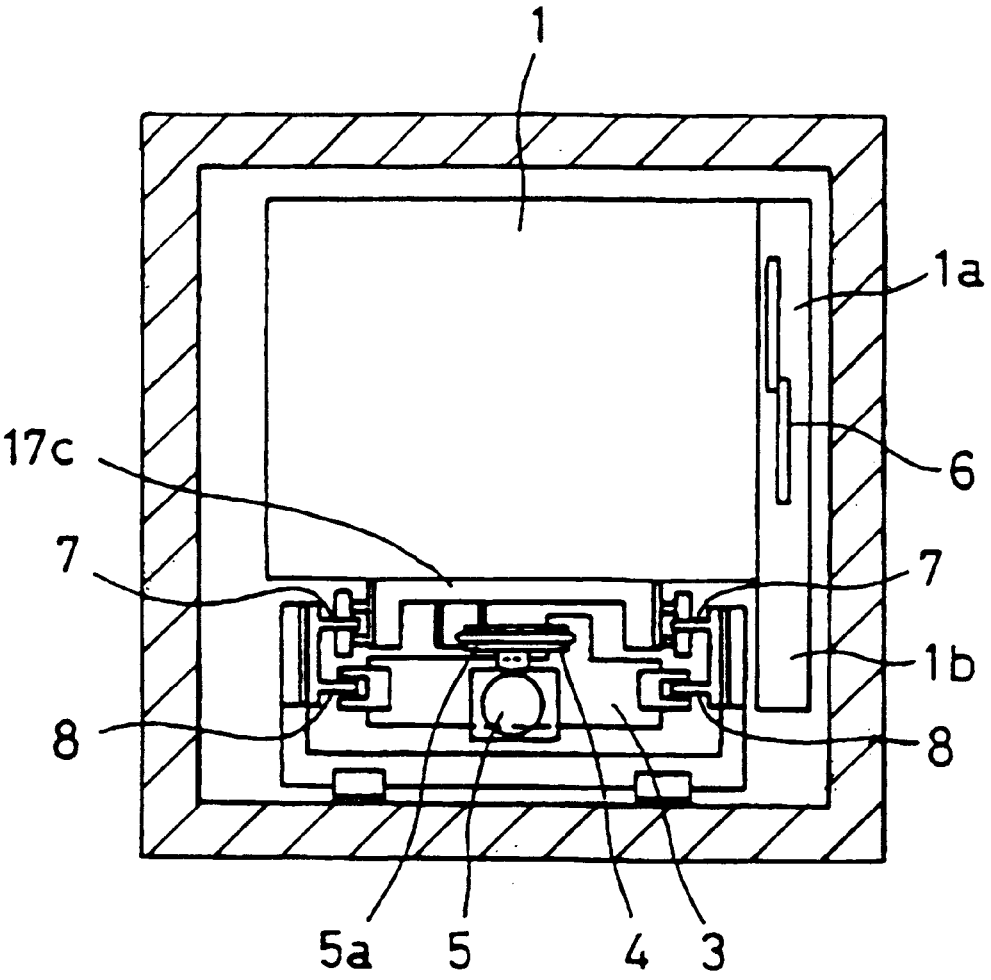
FIG. 5 is a top view of FIG. 4.
Figure 6:
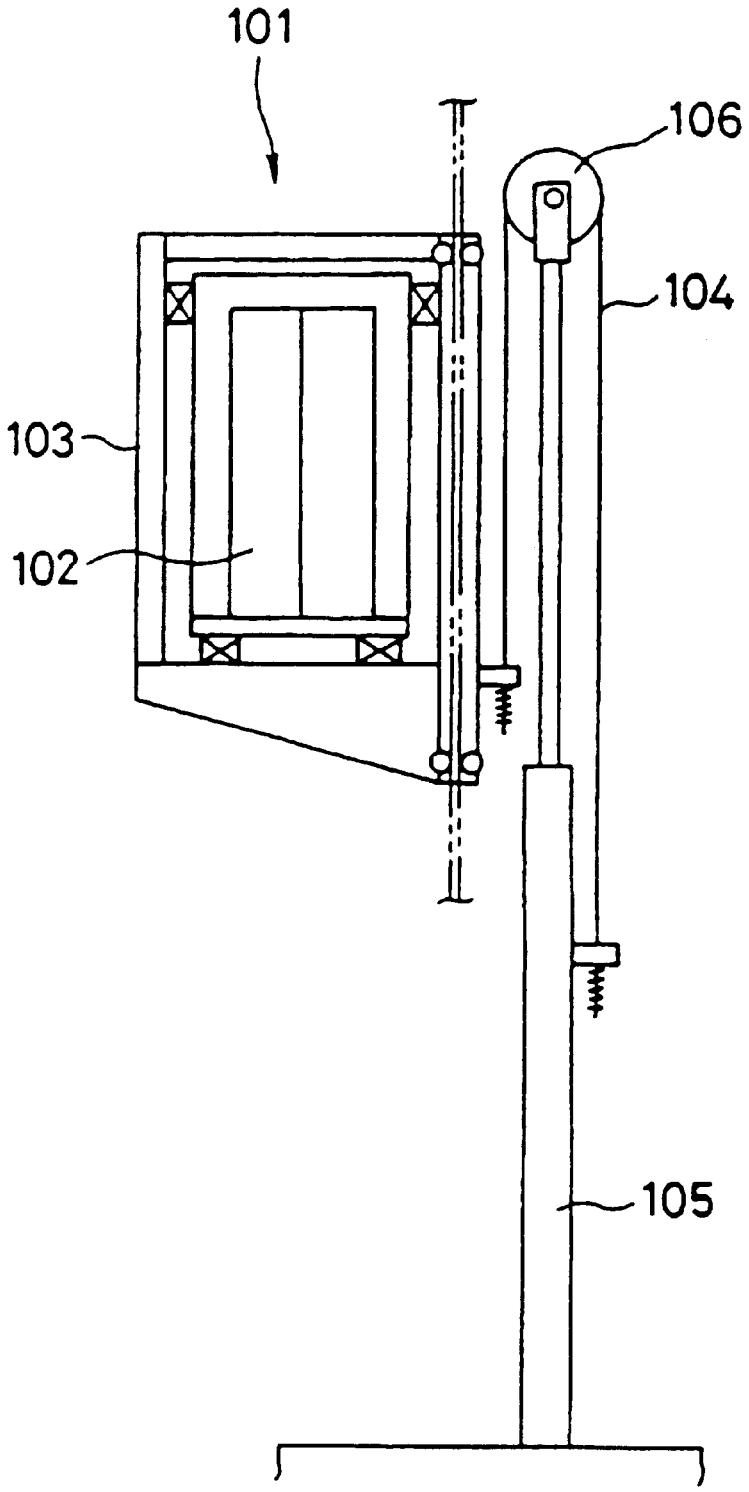
FIG. 6 is a front view of a prior art elevator.

In FIGS. 4 and 5, the symbol (1) indicates a car that is installed in an elevator hoistway (2) in a manner such that it can freely move up and down. A counterweight (3) is also installed to balance this car (1). One end of a rope (4) is attached to the car (1). This rope (4) is applied to a driving sheave (5*a*) of a hoist machine (5), with the other end being attached to the counterweight (3).

At the entrance/exit (1*a*) of the car (1), a single door (6) is installed in a manner such that it can open and close. At this entrance/exit (1*a*), a door recess (1*b*) is installed to accommodate the door when the door (6) is opened. On the car (1) in the side of the door recess, both a car rail (7) and a counterweight guide rail (8) are installed together.

Figure 1:
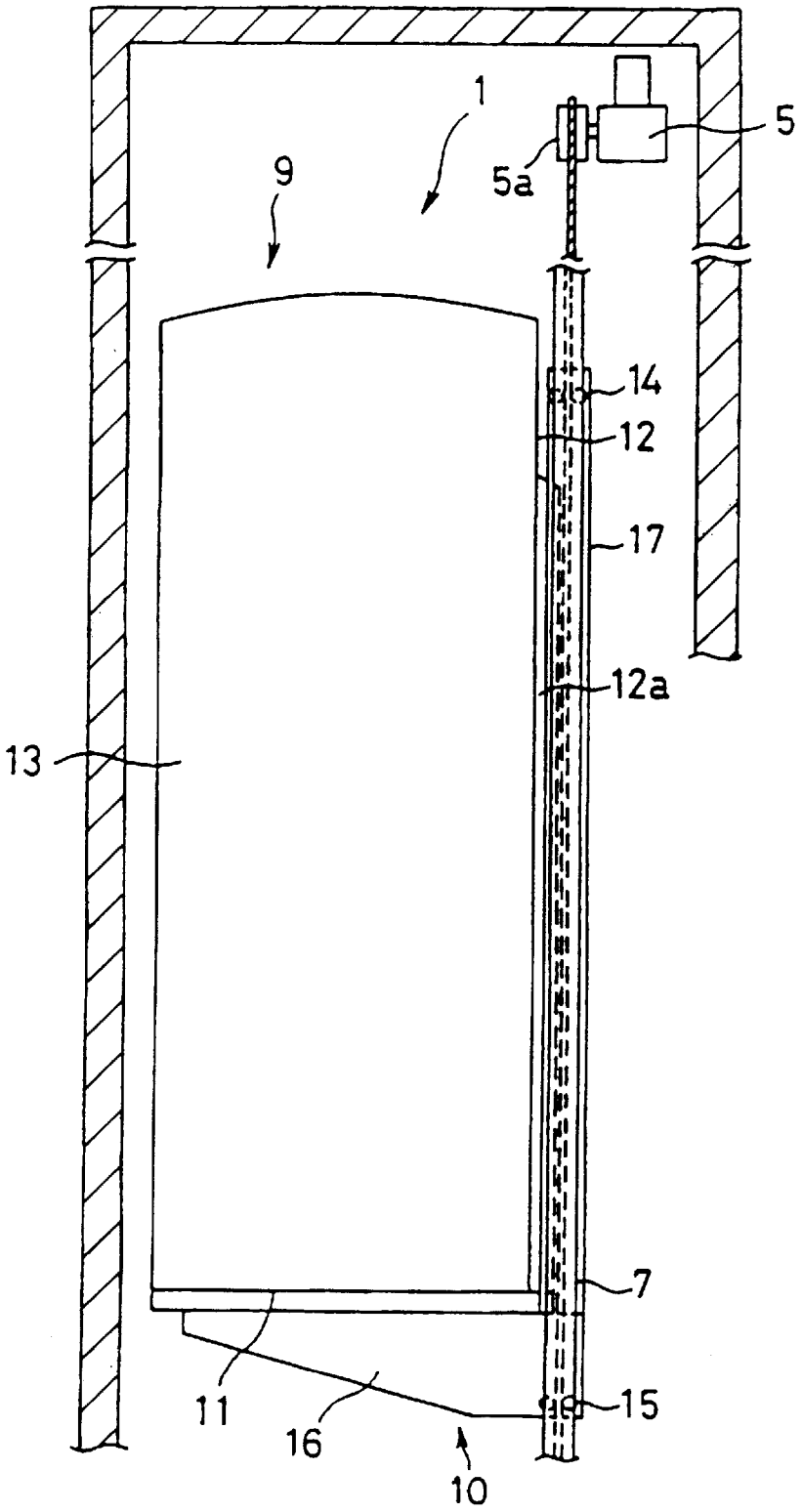
FIG. 1 is a front view that illustrates a elevator system in accordance with the present invention.
Figure 2:
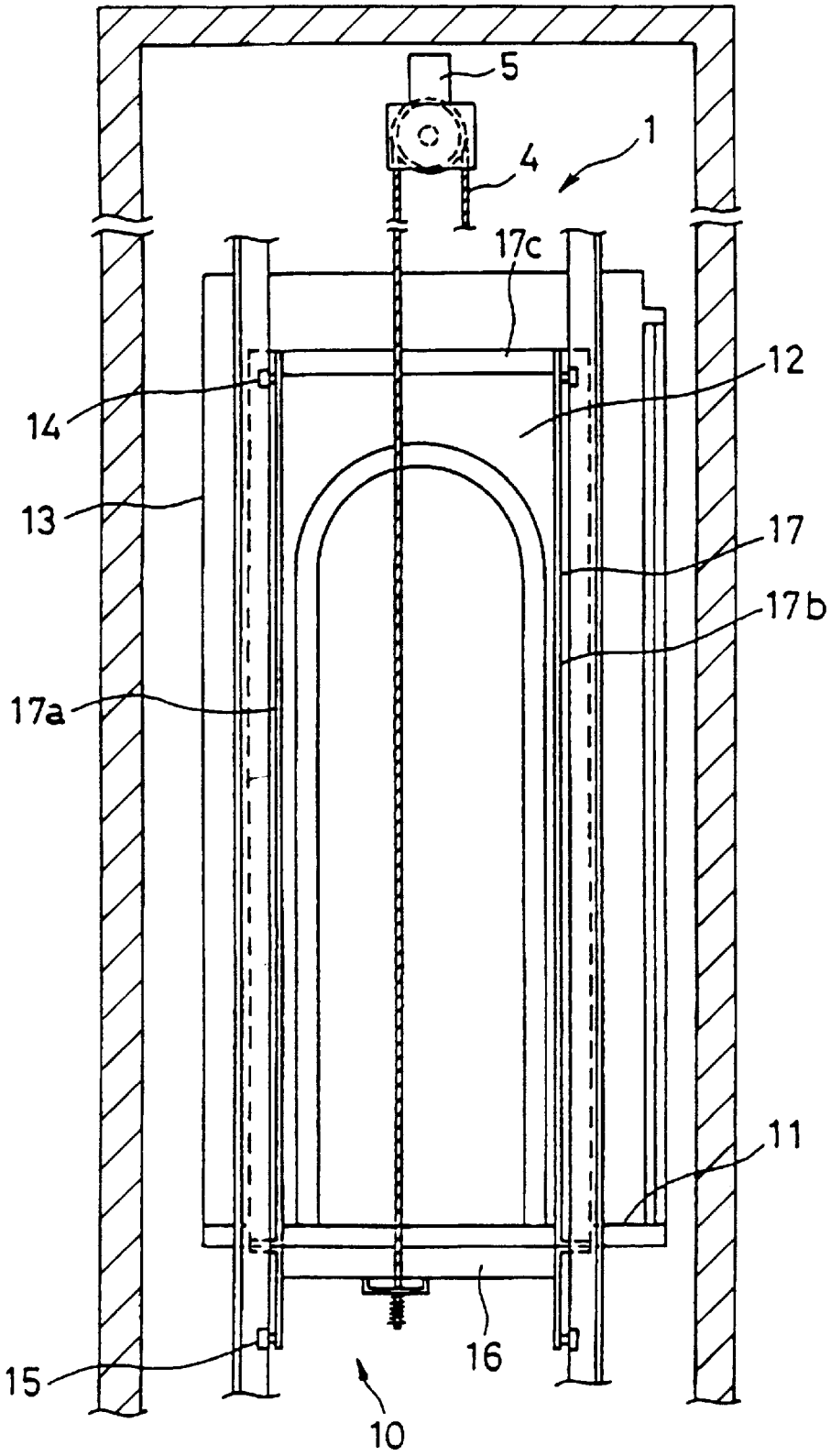
FIG. 2 is a side view of the elevator system.

As illustrated in FIGS. 1 and 2, the car (1) comprises a cab (9) and car frame (10). This cab (9) is made of glass-fiber-reinforced plastic, and has a floor (11), side panels (12), and a back panel (13) among others. The side panels (12) and back panel (13) engage the perimeter of the floor (11). Both the floor (11) and the side panels (12) of the cab (9) have a sandwich structure wherein urethane is inserted between glass-fiber-reinforced plastic. Therefore, the floor (11) and side faces (12) have a higher rigidity than the other parts. Also, at both the upper and lower ends of the car frame (7), roller guides (14) and (15) that engage with the car guide rail (7) are installed. The cab (9) is supported by the car guide rail (7) by means of the car frame (10) and the roller guides (14) and (15). The roller guides (14) and (15) define one means to engage the guide rail (7). Alternative means includes guide shoes.

The car frame (10), which supports the cab (9), consists of a lower frame (16) and a side frame (17). The lower frame (16) is fixed to the floor (11) and the side frame (17) is fixed to the side panel (12) with bolts, etc. The side frame (17) consists of a pair of longitudinal frame materials (17*a*) and (17*b*) positioned on both the left and right ends of the side panel (12), as well as the transverse frame material (17*c*) positioned on the upper end of these longitudinal frame materials (17*a*) and (17*b*).

Figure 3:
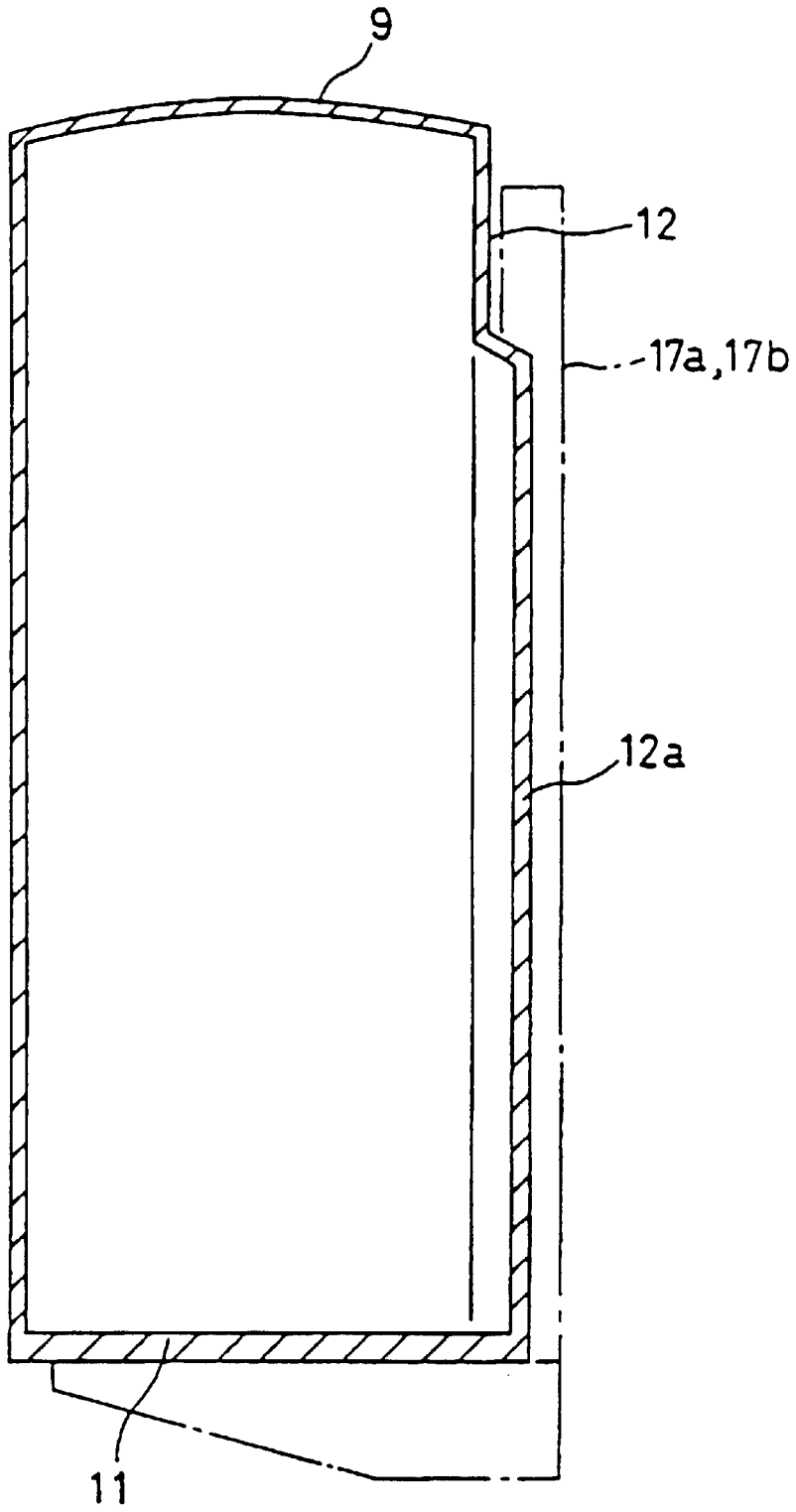
FIG. 3 is a cross-sectional view of the elevator system.

As illustrated in FIG. 3, the parts of the side panel (12) of the cab (9), where there are no longitudinal frame materials (17*a*) or (17*b*) or transverse frame material (17*c*) positioned, are formed to bulge outward such that an indentation is formed in the side panel (12). This bulging part (12*a*) of the side face (12) has a long shape that extends from the bottom face (11) upward. As shown in FIG. 2, the top end of the bulging part (12*a*) is round. The bulging part (12*a*) of the side face (12) does not extend outside the side frame (7). Therefore, the cab (11) has the largest capacity with regard to the size of the car (1) as a whole, including the car frame (10). That is, while the cab (9) has the maximum capacity within the desired design parameters, the car (1) as a whole can be made most compact.

In addition, as shown in FIGS. 1 and 4, the indentation formed by the shaped side panel (12*a*) permits the cab to be positioned adjacent to the machine (5) and sheave (5*a*) without interference. As a result, the machine (5) and sheave (5*a*) can be disposed in the hoistway without the need to extend the hoistway outward or to reduce the floor area of the cab (9).

When a person in a wheelchair uses a home elevator, an assistant often gets in the cab as well. Thus, if the assistant is positioned in the bulging part (12*a*) of the cab (9), he/she will fit well in a form such that he/she is standing by the wheelchair.

As explained above, by the present invention, on the side panel or the back panel of the cab where the side frame is positioned, the parts other than this side frame are made to bulge relatively outward. Thus, while abiding by the desired design parameters, the cab can be made to have the maximum capacity, and the car as a whole can be made most compact.

The embodiment illustrated in FIGS. 1–5 has the lower end of the side panel as the bulging portion with the upper end of the side panel spaced inward to form the indentation. It should be apparent to one skilled in the art that the indentation may be formed in either end of the side panel, or in either one of the side panels or in the back panel, in order to accommodate the location of the machine in the hoistway.

Although the invention has been shown and described with respect to exemplary embodiments thereof, it should be understood by those skilled in the art that various changes, omissions, and additions may be made thereto, without departing from the spirit and scope of the invention.

What is claimed is:

1. An elevator system including:

an elevator car traveling within a hoistway, the elevator car including a cab;

a rope engaged with the car to provide lifting force to the car; and a hoist machine disposed within the hoistway, the hoist machine engaged with the rope to drive the ropes and thereby provide lifting force to the car;

wherein the cab includes at least one panel having an indentation, and wherein the indentation accommodates the presence of the machine when the cab is adjacent to the machine.

2. The elevator system according to claim 1, wherein the panel is a side panel.

3. The elevator system according to claim 1, the cab including a platform and at least one side panel, the platform having a perimeter, the side panel having a lower end and an upper end, the lower end of the side panel engaging the perimeter of the platform and one of either the upper end or lower end of the side panel being spaced inward relative to the other of the upper end or lower end to define the indentation in the shape of the cab.

4. The elevator system according to claim 1, further including a car frame and a guide rail that extends through the hoistway, the car frame including means to engage the guide rail, wherein the machine is mounted on the guide rail, and wherein the cab is disposed within the car frame such that the indentation faces the guide rail.

5. An elevator system including an elevator cab traveling within a hoistway and a machine disposed within the hoistway, the cab including at least one panel having an indentation, wherein the indentation accommodates the presence of the machine when the cab is adjacent to the machine, wherein the machine is disposed in the upper portion of the hoistway, and wherein the indentation is disposed along the upper portion of the cab such that it accommodates the presence of the machine when the car is located at the upper portion of the hoistway.

6. An elevator system including an elevator cab traveling within a hoistway and a machine disposed within the hoistway, the cab including a platform having a perimeter and at least one side panel having an indentation, wherein the indentation accommodates the presence of the machine when the cab is adjacent to the machine, the side panel having a lower end and an upper end, the lower end of the side panel engaging the perimeter of the platform, wherein the machine is disposed in the upper portion of the hoistway, and wherein the upper end of the side panel is spaced inward relative to the lower end such that the indentation accommodates the presence of the machine when the car is located at the upper portion of the hoistway.

* * * * *